US005672121A

United States Patent [19]

Miller

[11] Patent Number: 5,672,121

[45] Date of Patent: Sep. 30, 1997

[54] APPARATUS FOR POSITIONING A GOLF BALL ON A TEE AND FOR RETRIEVING GOLF BALLS AND TEES

[76] Inventor: Leroy J. Miller, 4521 Altura, NE., Albuquerque, N. Mex. 87110

[21] Appl. No.: 639,635

[22] Filed: Apr. 29, 1996

[51] Int. Cl.[6] ..... A63B 57/00

[52] U.S. Cl. ..... 473/386; 294/19.2

[58] Field of Search ..... 473/386, 132; 294/19.1, 19.2

[56] References Cited

U.S. PATENT DOCUMENTS

| | | | |
|---|---|---|---|
| 4,616,826 | 10/1986 | Trefts | 473/386 |
| 4,714,250 | 12/1987 | Henthorn | 473/386 |
| 4,819,938 | 4/1989 | Hill | 294/19.2 |
| 4,949,961 | 8/1990 | Milano | 473/386 |
| 4,969,646 | 11/1990 | Tobias | 473/386 |
| 5,205,598 | 4/1993 | Miller | 473/386 |
| 5,330,177 | 7/1994 | Rogge | 294/19.2 |

*Primary Examiner*—Steven B. Wong
*Attorney, Agent, or Firm*—Samuel M. Freund

[57] ABSTRACT

Apparatus for positioning a golf ball on a tee and for retrieving golf balls and tees. A hand-operated apparatus for setting golf balls on tees without requiring the golfer to bend is described. The device may also be used for retrieving golf balls and tees, and may itself be retrieved if dropped by using the handle of a golf club. The apparatus comprises a hollow outer shaft having a fixed handle at one end and a base for pivotably holding two golf ball encircling jaws at the other. An inner shaft, slidably disposed within the outer shaft and connected to a movable handle at one end, and jaw-actuating wires at the other permits a user to operate the jaws with one hand. A coil spring located between the fixed and movable handles provides a force therebetween, keeping the jaws closed in their normal position. A golf ball and tee placed within the jaws may be set in the ground by pushing on the fixed handle, and released from the apparatus, such that the golf ball remains on the tee, by pulling the movable handle against the operation of the spring.

3 Claims, 5 Drawing Sheets

APPARATUS FOR POSITIONING A GOLF BALL ON A TEE AND FOR RETRIEVING GOLF BALLS AND TEES

FIELD OF THE INVENTION

The present apparatus relates generally to apparatus for assisting golfers and, more particularly, to a golf ball and tee setting apparatus which may also be used for retrieving golf balls and tees.

BACKGROUND OF THE INVENTION

Every hole played in a round of golf requires the golfer to insert a tee into the turf in the tee area and to position a golf ball on the inserted tee. Typically, the player must hold the golf ball and tee as an assembly in his or her hand and drive the shank of the tee into the ground with a downward force on the ball. To accomplish this task, the golfer may have to bend at the waist or kneel. Retrieving golf balls and tees requires a similar effort. Moreover, if the ground is hard, significant hand strength and coordination may be necessary. Consequently, some individuals may not be able to participate in the sport.

A partial summary of the prior invention in the area of golf ball and tee setting devices is provided by Salvatore Milano in U.S. Pat. No. 4,949,961 for "Golf Ball Setter," which issued on Aug. 21, 1990. Therein, the inventor describes an apparatus having a wedge and a wheel-operated, spring biased, normally closed clamp located at one end of a handle. The clamp is openable and adapted for receiving a golf ball such that the golf ball may be set on a captured tee a desired height above the ground. A pivoted lever located near the other end of the handle operates the clamp. The described clamp does not cover a significant portion of the surface of the golf ball, and the spring bias is located on the clamp itself.

In "Golf Ball And Tee Setter," U.S. Pat. No. 4,714,250, which issued to Clyde E. Henthorn on Dec. 22, 1989, a golf ball and tee setter for simultaneously holding a ball and tee prior to inserting the tee into the ground, and for releasing the ball and tee with the ball remaining in the teed position is described. Opposing cup members, normally held in the closed position by a spring positioned therebetween, are pivotably located at one end of a handle and simultaneously hold a golf ball and tee when in the closed position. The cups are moved to the open position by a hand-operated chain mechanism accessible at the other end of the handle attached to the pivoted cup members.

"Golf Tee Set Apparatus," U.S. Pat. No. 5,330,177, which issued to Mark Rogge on Jul. 19, 1994, describes a golf ball and tee setting device having first and second cooperative jaw legs arranged to secure the golf ball and tee members. An outer handle sleeve cooperates with a support post such that the displacement of the sleeve relative to the support post closes the jaw legs to secure the golf ball and tee between the legs, with the golf ball positioned over the tee. Tension between the support post and sleeve is provided by a spring located near the end of the handle away from the jaw legs. A spring is also placed between the jaws to assist in opening the jaw legs. Again, the jaw legs do not cover a substantial portion of the golf ball.

Accordingly, it is an object of the present invention to provide a golf ball and tee setting apparatus which has superior golf ball stabilizing capability, and which does not have spring members located in the region of the jaws, thereby reducing the effects of mud and sand on the operation thereof.

Another object of the invention is to provide a golf ball and tee setting apparatus which may be used to retrieve golf balls and tees without requiring the user thereof to bend or kneel.

Yet another object of the present invention is to provide a golf ball and tee setting apparatus which may itself be retrieved if dropped without requiring the user thereof to bend or kneel.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus for positioning a golf ball on a tee and for retrieving golf balls and tees of this invention may comprise in combination: an elongated hollow shaft having an upper end and a lower end, the shaft having a first slot located near its upper end and a second slot located near its lower end; a base having a free end and an attached end, the attached end being attached to the lower end of the hollow shaft; a first jaw having a concave inner portion adapted for receiving a golf ball and an outer portion, one end of the first jaw being pivotably attached to the base near the free end of the base, the first jaw further having a tapered portion for receiving the head and a portion of the shank of a golf tee located near the end of the jaw away from its pivoted end; a second jaw having a concave inner portion adapted for receiving the golf ball and an outer portion, one end of the second jaw being pivotably attached to the base near the free end of the base, the second jaw further having a tapered portion for receiving the head portion and a portion of the shank of the golf tee located near the end of the jaw away from its pivoted end, the two jaws being disposed with their concave inner portions opposing; a fixed handle attached to the upper end of the hollow shaft; an inner shaft which slidably moves inside the hollow shaft, the inner shaft having an upper end and a lower end; a first jaw actuator attached at one end to the lower end of the inner shaft and the other end thereof being pivotably attached to the outer portion of the first jaw, the first jaw actuator exiting the hollow shaft through the second slot in the shaft; a second jaw actuator attached at one end to the lower end of the inner shaft and the other end thereof being pivotably attached to the outer portion of the second jaw, the second jaw actuator exiting the hollow shaft through the second slot in the shaft on the opposite side from the first jaw actuator; a movable handle attached to the upper end of the inner shaft and emerging through the first slot in the hollow shaft; and a coil spring for providing a force between the hollow shaft and the inner shaft; whereby the golf ball is stably held against the tee by the action of the two jaws such that the tee can be inserted into the ground with the golf ball positioned on the tee when the movable handle is permitted to respond to the coil spring and the operator presses on the fixed handle, the golf ball remaining on the tee when the jaws are caused to pivot away from each other when the operator moves the movable handle against the action of the coil spring toward the fixed handle.

Preferably, the base has a concave portion in the free end thereof which substantially matches the curvature of the golf ball.

It is also preferred that the movable handle is adapted to slidably move in the first slot in the hollow shaft.

Benefits and advantages of the present invention include the ability to retrieve golf balls and tees without having to bend, freedom from concern about mud and sand clogging the mechanism, and the ability to pick up a dropped apparatus without having to bend by using the handle grip end of a golf club.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION

Briefly, the present invention includes a hand-operated apparatus for setting golf balls on tees without requiring the golfer to bend. The device may also be used for retrieving golf balls and tees, and may itself be retrieved if dropped by using the handle of a golf club. The apparatus comprises a hollow outer shaft having a fixed handle at one end and a base for pivotably holding two golf ball encircling jaws at the other. An inner shaft, slidably disposed within the outer shaft and connected to a movable handle at one end, and jaw-actuating wires at the other permits a user to operate the jaws with one hand. A coil spring located between the fixed and movable handles provides a force therebetween, keeping the jaws normally closed. A golf ball and tee placed within the jaws may be set in the ground by pushing on the fixed handle and released from the apparatus, such that the golf ball remains on the tee, by pulling the movable handle against the operation of the spring.

Figure 1:
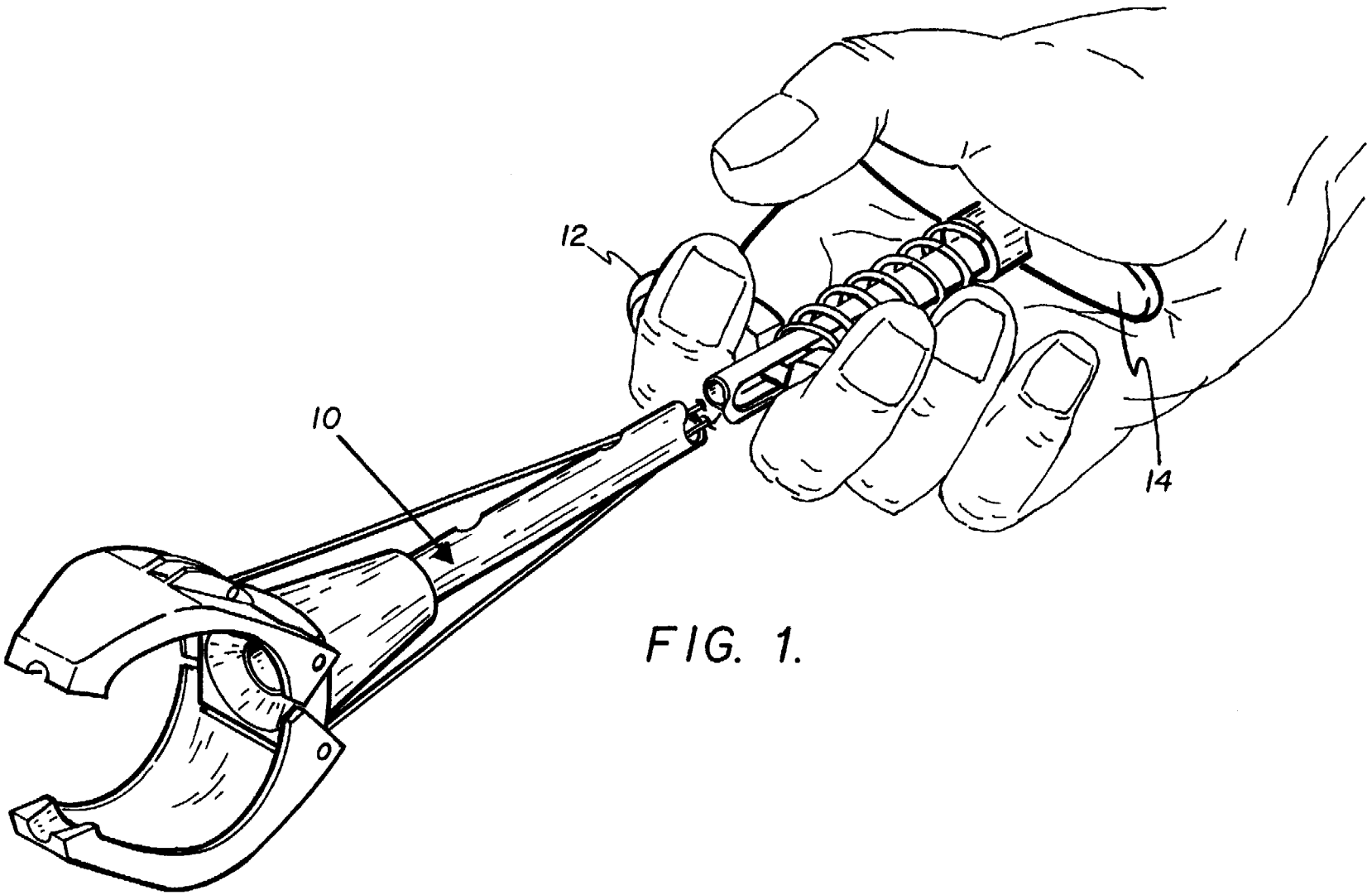
FIG. 1 is a schematic representation of a perspective view of the apparatus of the present invention showing the open condition thereof.
Figure 2:
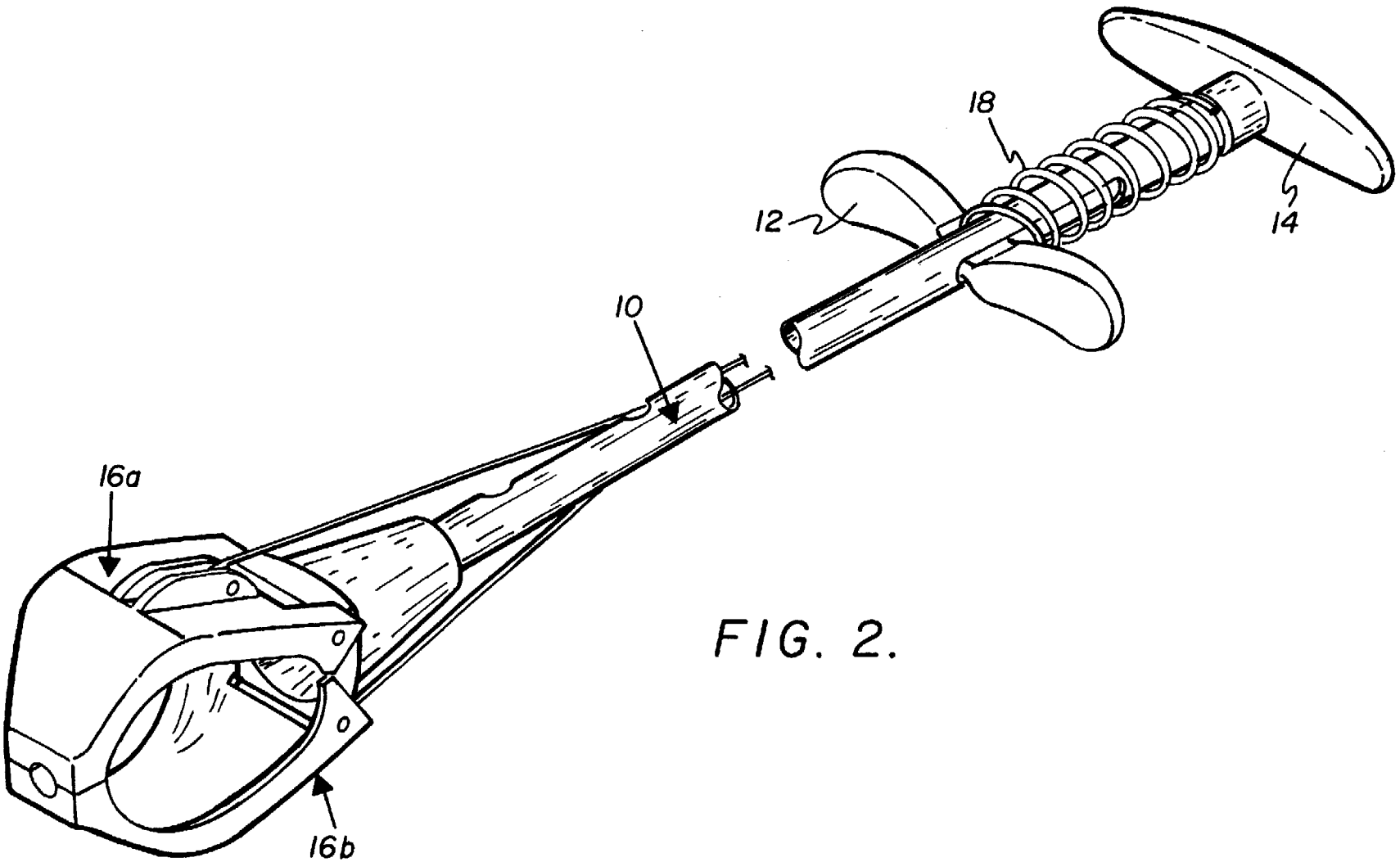
FIG. 2 is a schematic representation of the perspective view of the apparatus of the present invention illustrated in FIG. 1 hereof, showing the apparatus in its normally closed condition.
Figure 3:
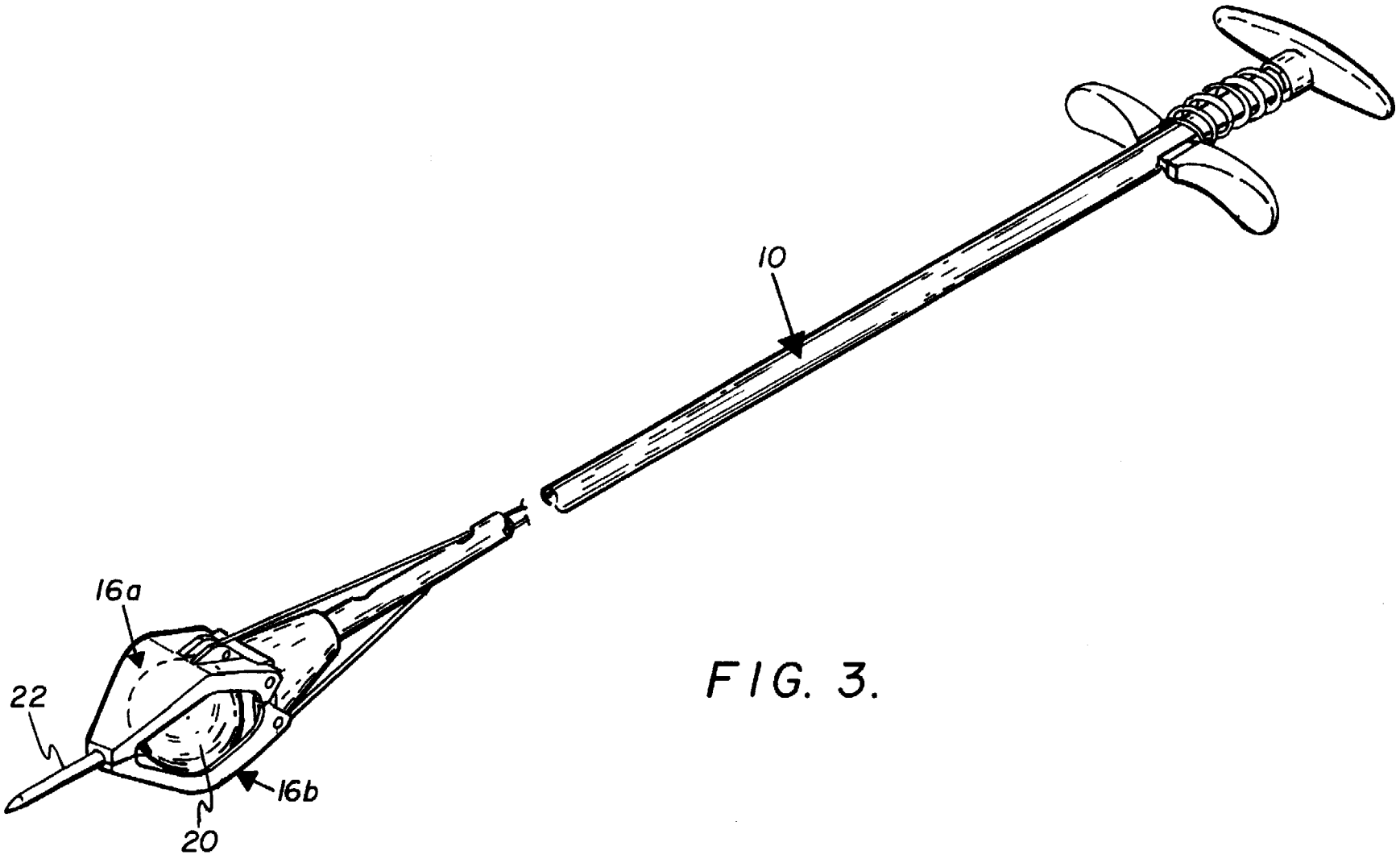
FIG. 3 is a schematic representation of the apparatus of the present invention shown in FIG. 2 hereof illustrating the retention thereby of a golf ball and tee.

Reference will now be made in detail to the present preferred embodiment of the invention, an example of which is illustrated in the accompanying drawings. Similar or identical structure is identified throughout using identical callouts. Turning now to the Figures, FIG. 1 is a schematic representation of a perspective view of the apparatus, 10, of the present invention showing the open condition thereof which is achieved when movable handle, 12, is pulled toward fixed handle, 14, by the operator of the device. FIG. 2 is a schematic representation the perspective view of apparatus 10 illustrated in FIG. 1 hereof, showing the device where jaws, **16*a* and 16*b*, are their normally closed condition. This condition is achieved by permitting coil spring, 18, to force movable handle 12 away from fixed handle 14. FIG. 3 is a schematic representation of apparatus 10 illustrating the retention golf ball, 20, and tee, 22, by jaws 16*a* and 16*b***.

Figure 4:
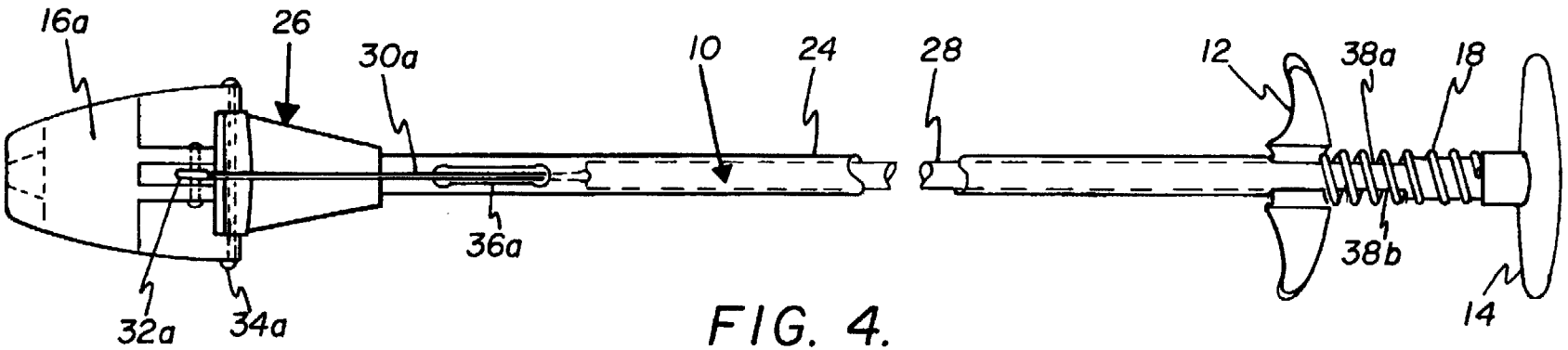
FIG. 4 is a side view of the present apparatus showing the cooperation of the inner shaft member, the jaw-actuating means, the fixed handle, the movable handle and the coil spring in operating the jaw members.
Figure 5:
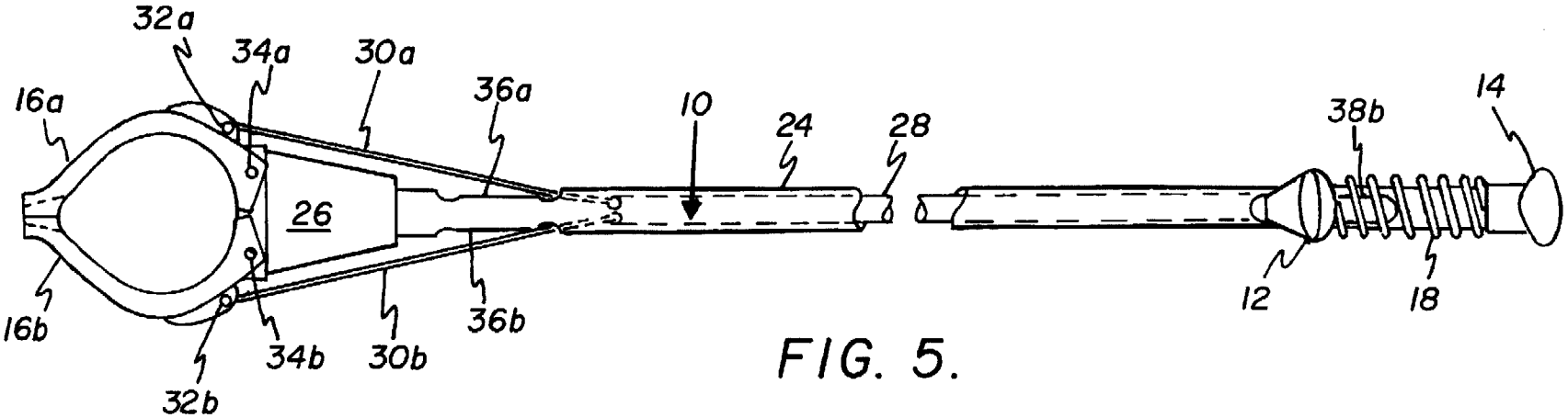
FIG. 5 is a front view of the apparatus shown in FIG. 4, hereof.

FIG. 4 is a side view of apparatus 10 showing the cooperation of all of the parts of the device. Hollow shaft, 24, which is fabricated from metal or sturdy plastic, separates a base, 26, which pivotably supports jaws **16*a* and 16*b* from handles 12 and 14 of the apparatus. Its length is determined by the height of the golfer. Inner shaft member, 28, is fixedly connected to movable handle 12 at one end, and jaw-actuating means, 30*a* and 30*b* (not shown in FIG. 4). Jaw-actuating means 30*a* and 30*b* are pivotably connected on the outside of jaws 16*a* and 16*b*, respectively, using pivots, 32*a* and 32*b* (not shown in FIG. 4), which are connected to base 26 using pivots, 34*a* and 34*b* (not shown in FIG. 4). The jaw-actuating means are conveniently fabricated from sturdy wires. The location of the pivots and jaw actuators reduces the effects of mud and sand on the operation of the present device. Slots, 36*a* and 36*b* (not shown in FIG. 4), and slots, 38*a* and 38*b*, permit jaw-actuator wires 30*a* and 30*b* to exit from hollow outer shaft 24, and movable handle 12 to slidably move therein, respectively. Motion of movable handle 12, then, operates jaws 16*a* and 16*b* through the action of slidable shaft 28 within hollow shaft 24 and jaw-actuator wires 30*a* and 30*b***. FIG. 5 is a front view of the apparatus shown in FIG. 4, hereof.

Figure 7:
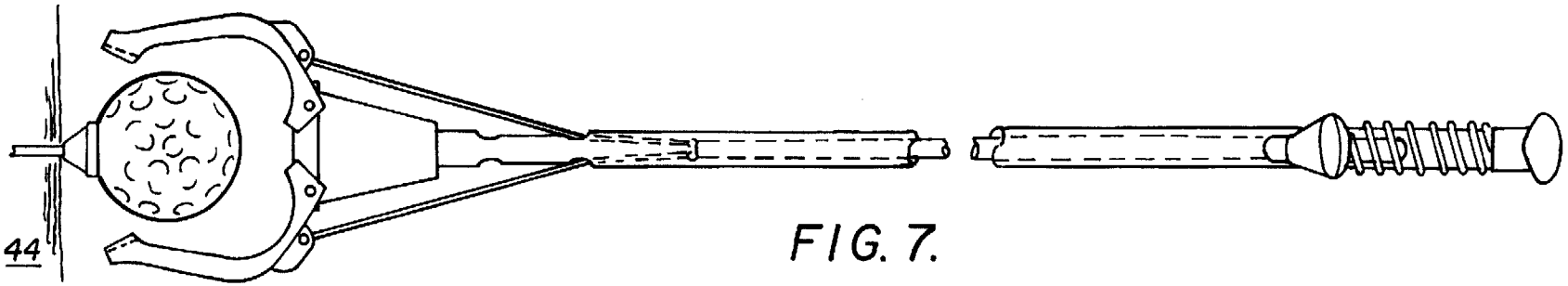
FIG. 7 shows the release of the golf ball and tee from the apparatus in the ready-for-play configuration.
Figure 6:
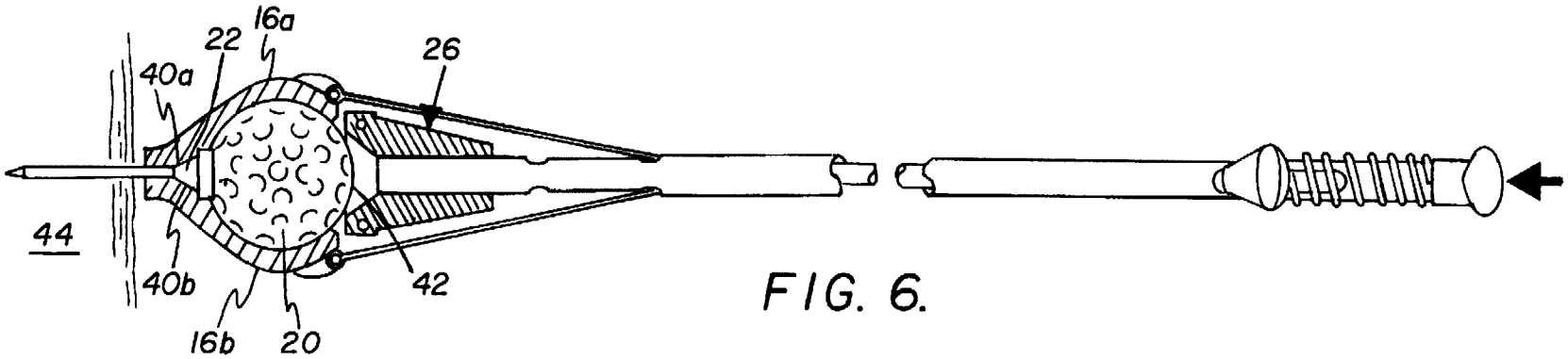
FIG. 6 shows the placement of a golf ball and tee into the soil using the present apparatus.

FIG. 6 shows the placement of a golf ball and tee into the soil using the present apparatus. Golf ball 20 is placed on tee 22 and the assembly secured between jaws **16*a* and 16*b* by first moving handle 12 toward handle 14 against the action of spring 18, which opens the jaws, and then releasing handle 12, which closes the jaws securely around the golf ball/tee assembly. This operation may be performed using one hand. In a preferred embodiment of the invention, jaws 16*a* and 16*b* are adapted to receive the head and a portion of the shank of tee 22 by indentations, 40*a* and 40*b*. Additionally, base 26 is adapted to receive golf ball 22 by having a spherical-shaped depression, 42, formed therein. This depression is more clearly shown in the perspective view of FIG. 1 hereof. Both of these features assist in firmly securing the golf ball/tee assembly. The next operation is inserting tee 22 a chosen distance into the ground, 44, by pushing on fixed handle 14. After the insertion operation, movable handle 12 is once again moved toward fixed handle 14, which opens jaws 16*a* and 16*b***, thereby releasing the golf ball/tee assembly with the golf ball remaining on the tee and ready for play. This is shown schematically in FIG. 7 hereof. It should be mentioned that the present apparatus may also be used for picking up golf balls and tees, and may itself be recovered if dropped by the user by inserting the handle end of a golf club into the closed jaws of the dropped device.

The foregoing description of the invention has been presented for purposes of illustration and description and is not intended to be exhaustive or to limit the invention to the precise form disclosed, and obviously many modifications and variations are possible in light of the above teaching.

The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for positioning a golf ball on a tee and for retrieving golf balls and tees, which comprises in combination:

a. an elongated hollow shaft having an upper end and a lower end, said shaft having a first slot therein located in the vicinity of the upper end thereof and a second slot therein located in the vicinity of the lower end thereof;

b. a base having a free end and an attached end, the attached end thereof being attached to the lower end of said hollow shaft;

c. a first jaw member having a concave inner portion adapted to receive said golf ball and an outer portion, one end of said first jaw member being pivotably attached to said base in the vicinity of the free end thereof, said first jaw member further having a tapered portion adapted to receive the head and a portion of the shank of said golf tee located in the vicinity of the end thereof away from the pivoted end;

d. a second jaw member having a concave inner portion adapted to receive said golf ball and an outer portion, one end of said second jaw member being pivotably attached to said base in the vicinity of the free end thereof, said second jaw member further having a tapered portion adapted to receive the head portion and a portion of the shank of said golf tee located in the vicinity of the end thereof away from the pivoted end, said first jaw member and said second jaw member being disposed such that the concave inner portions thereof are opposing;

e. a fixed handle attached to the upper end of said shaft;

f. an inner shaft adapted to slidably move inside of said hollow shaft, said inner shaft having an upper end and a lower end;

g. a first jaw-actuating member attached at one end thereof to the lower end of said inner shaft, said first jaw-actuating member exiting said hollow shaft through the second slot therein, the other end thereof being pivotably attached to the outer portion of said first jaw member;

h. a second jaw-actuating member attached at one end thereof to the lower end of said inner shaft, said second jaw-actuating member exiting said hollow shaft through the second slot therein on the opposite side thereof from said first jaw-actuating member, the other end thereof being pivotably attached to the outer portion of said second jaw member;

i. a movable handle attached to the upper end of said inner shaft through the first slot in said hollow shaft; and j. a coil spring for providing force between said hollow shaft and said inner shaft; whereby said golf ball is stably held against said tee by the action of said first jaw member and said second jaw member such that said tee can be inserted into the ground with said golf ball thereon when said movable handle is permitted to respond to said coil spring and said fixed handle is moved in the direction of the ground, said golf ball remaining thereon when said first jaw member and said second jaw member are caused to pivot away from one another by moving said movable handle against the action of said coil spring toward said fixed handle.

2. The apparatus for remotely positioning a golf ball on a tee and for retrieving golf balls and tees as described in claim 1, wherein said base has a concave portion in the free end thereof which substantially matches the curvature of said golf ball.

3. The apparatus for remotely positioning a golf ball on a tee and for retrieving golf balls and tees as described in claim 1, wherein said movable handle is adapted to slidably move in the first slot in said hollow shaft.

* * * * *